US011835183B1

(12) United States Patent
Figueroa et al.

(10) Patent No.: US 11,835,183 B1
(45) Date of Patent: Dec. 5, 2023

(54) BOOSTER-EJECTOR SYSTEM FOR CAPTURING AND RECYCLING LEAKAGE FLUIDS

(71) Applicant: Flowserve Management Company, Irving, TX (US)

(72) Inventors: Luis Figueroa, Calgary (CA); Dennis van Graefschepe, Terneuzen (NL)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 18/104,347

(22) Filed: Feb. 1, 2023

(51) Int. Cl.
*F17D 1/065* (2006.01)
*F17D 5/00* (2006.01)
*F17D 3/01* (2006.01)

(52) U.S. Cl.
CPC ..... *F17D 1/065* (2013.01); *F17D 3/01* (2013.01); *F17D 5/005* (2013.01); *Y10T 137/2599* (2015.04); *Y10T 137/5762* (2015.04)

(58) Field of Classification Search
CPC . F17D 1/065; F17D 3/01; F17D 5/005; Y10T 137/2599; Y10T 137/5762; Y10T 137/5835; Y10T 137/5907
USPC ..... 137/115.11, 312, 313, 314; 73/40.7, 46
See application file for complete search history.

(56) References Cited

U.S. PATENT DOCUMENTS 24,212 A 5/1859 Holmes
32,184 A 4/1861 Cutler
2,276,371 A * 3/1942 Cooper ..... B64D 13/02 137/115.11
2,438,245 A * 3/1948 Gregg ..... F15B 1/26 60/455
2,440,371 A * 4/1948 Holley, Jr. ..... F04C 14/02 137/115.11
2,746,250 A * 5/1956 Hawkins ..... B64C 25/44 261/78.2
2,747,598 A * 5/1956 Wooldridge ..... B64F 1/28 137/115.11
2,823,690 A * 2/1958 Dodge ..... B62D 5/062 137/115.11
2,829,664 A * 4/1958 Mountford ..... F16K 31/1225 137/115.11

(Continued)

FOREIGN PATENT DOCUMENTS

FR 2876981 A1 4/2006
JP 57061898 A 4/1982

(Continued)

*Primary Examiner* — William M McCalister
(74) *Attorney, Agent, or Firm* — Maine Cernota & Curran

(57) ABSTRACT

A booster-ejector system captures and recycles leakage fluids from a process. When a pressure differential (head) of the process is above a threshold value, an ejector system uses motive fluid from a process high-pressure (HP) region to entrain and compress the leakage fluid, and direct it to a low pressure (LP) region. When the head is below the threshold value, a controller reconfigures a plumbing system and activates a leakage pump to pump the leakage fluid to the LP region. The system can include only one ejector, or a plurality thereof, which can be coupled such that the diffuser output of each ejector is directed to the suction input of the next ejector. At least one of the ejectors can include an exchangeable throat, which can impart a rotational component to the fluid. The HP and LP regions can be the output and input, respectively, of a compressor.

15 Claims, 10 Drawing Sheets

(56) References Cited

U.S. PATENT DOCUMENTS

| | | | | |
|---|---|---|---|---|
| 4,840,195 | A * | 6/1989 | Zabrenski | G05D 16/10 137/557 |
| 6,029,506 | A * | 2/2000 | Dilger | G01N 1/2226 73/46 |
| 6,112,528 | A | 9/2000 | Rigby | |
| 6,401,486 | B1 | 6/2002 | Lee | |
| 6,484,745 | B1 * | 11/2002 | Navarro | B67D 1/1256 137/15.05 |
| 6,722,399 | B1 | 4/2004 | Cano | |
| 7,810,572 | B2 | 10/2010 | Brandt | |
| 8,066,023 | B2 * | 11/2011 | Hoffart | F25J 1/0022 137/312 |
| 8,100,671 | B2 | 1/2012 | Botros | |
| 2007/0267063 | A1 * | 11/2007 | Davis | B08B 3/026 137/115.11 |
| 2008/0251129 | A1 * | 10/2008 | Hoffart | F25J 1/0279 137/312 |
| 2019/0331139 | A1 | 10/2019 | Short | |

FOREIGN PATENT DOCUMENTS

| | | | |
|---|---|---|---|
| RO | 121730 | B1 | 3/2008 |
| RU | 2225270 | C1 | 3/2004 |
| WO | 2014086415 | A1 | 6/2014 |
| WO | 2015189628 | A1 | 12/2015 |
| WO | 2016056946 | A1 | 4/2016 |
| WO | 2022069906 | A1 | 4/2022 |

* cited by examiner

BOOSTER-EJECTOR SYSTEM FOR CAPTURING AND RECYCLING LEAKAGE FLUIDS

FIELD OF THE INVENTION

The invention relates to systems for processing leakage fluids, and more particularly, to systems for recapturing and compressing leakage fluids.

BACKGROUND OF THE INVENTION

Systems that transport, compress, circulate, and/or store process fluids are often subject to leakage. This can be due to degradation over time of joints, seals, or other components, and/or it can be inherent to the design of the system. For example, an end face liquid mechanical seal or an end face dry gas mechanical seal will, by design, always produce a small amount of leakage fluid due to the non-contacting operation of the seal end faces.

A simplified example is presented in FIG. 1A, where a hydrocarbon gas or a liquid such as liquified natural gas LNG gas evaporated at relatively low pressure flows into the input 100 of a compressor 102. The pressurized gas is then delivered from the outlet 104 of the compressor 102 to a gas distribution system, or to a compressed gas container for transport to a final destination. In this simplified example, the compressor 102 includes an impeller (not shown) mounted on a rotating shaft 106 that is driven by a motor 108. A dry gas seal 110 is provided to reduce leakage of gas out of the compressor 102 along the rotating shaft 106. However, the dry gas seal 110 necessarily permits a small amount of leakage of the gas, which is directed into a leakage line 112. In similar situations a slow leak might develop from a defective or worn joint or fitting.

For many applications, the release of a small amount of leaked process fluid, also referred to herein as "leakage fluid," into the environment is acceptable and tolerable. For example, the system illustrated in FIG. 1A simply vents the leakage gas from the leakage line 112 into an atmospherically "safe" location.

In other applications, however, it is desirable to avoid releasing even small amounts of leaked process fluids, because they are toxic and/or harmful to the environment. In some of these cases, an inert "buffer" fluid that is at a higher-pressure than the process fluid is applied to locations of expected or potential leakage, so that any leakage is of the buffer fluid into the process, rather than process fluid into the environment. An example would be to introduce pressurized nitrogen gas into a housing that surrounds an end face dry gas seal. While this approach can be effective, it has the disadvantage of adulterating the process fluid with the buffer fluid. In addition, the requirement to provide a buffer gas adds cost and complexity to the system, by requiring that a source of pressurized buffer gas be provided and replenished as needed.

Another approach in the case of hydrocarbon process fluids is simply to collect the leakage fluid and "flame" it, i.e. burn it so that any toxic hydrocarbons are converted to water and carbon dioxide. However, this approach has the disadvantage that the leakage fluid is wasted. Furthermore, carbon dioxide, while not toxic, is an undesirable greenhouse gas, the release of which is harmful to the environment, and may fall under increasingly stringent government-imposed limits and restrictions.

With reference to FIG. 1B, still another approach is to collect the leakage fluid, compress it using a secondary pump or compressor 114, and then reintroduce it into the process stream, for example into the input 100 of a primary compressor 102. In the illustrated example, the secondary compressor is a reciprocal booster 114, which can be an appropriate choice for low pressures (below 25 psi) and flow rates (below 4 SCFM), and is less prone to leakage than a rotary booster. This approach has the advantages that the leakage fluid is not wasted, and at the same time is not introduced into the environment in any form. However, when leakage rates are low, then the energy cost of operating the pump or compressor can be prohibitive.

What is needed, therefore, is a system and method for processing leakage fluids that reduces or avoids release of the leakage fluid or its combustion products into the environment, while minimizing energy costs.

SUMMARY OF THE INVENTION

The present invention is a system and method for recapturing and recycling leakage fluids while reducing or avoiding release of the leakage fluid or its combustion products into the environment, and while minimizing energy costs. The invention is applicable to systems in which a process fluid is present at both a higher-pressure and a lower pressure, for example a system that includes a compressor that compresses a process fluid, so that the compressor has a relatively lower-pressure fluid input and a relatively higher-pressure fluid output.

It will be noted that examples and descriptions are sometimes presented herein with reference to a system that compresses a gas, such as natural gas, and that captures and recycles leaked quantities of the gas. However, it should be understood that the present disclosure applies equally to systems for which the process fluid is a liquid, unless otherwise required by context. Examples are presented herein where the leakage fluid arises from a compressor, for example from a shaft seal, fitting, or joint within the compressor. However, is should be understood that, in general, the invention is applicable to recapturing and recycling leaked process fluid that arises from any source of leakage, so long as a higher-pressure source of the process fluid is available, as well as another location where the process fluid is present at a lower pressure.

According to the present invention, an ejector is implemented as a primary capture mechanism for capturing and re-compressing leakage fluid. Higher-pressure fluid, for example the output of a compressor, is provided as the "motive fluid" for the ejector, while the suction input of the ejector is connected to the source of the leaked fluid. The ejector then functions to draw in the leakage fluid, which is entrained in the motive fluid, after which the mixture of motive fluid and leakage fluid, referred to herein as the "process fluid mixture," is compressed in the diffuser section of the ejector and delivered to the location where the process fluid is at a lower pressure, for example to the input of the compressor.

This approach is highly energy efficient, in that the ejector is simple in design and does not consume any electrical power. Because of the low flow rate of the leakage fluid, and the consequent low flow that is required of the motive fluid, there is only a negligible loss in the efficiency of the system due to the redirection of high-pressure fluid to the ejector.

Of course, the ability of the ejector to apply suction to draw in the leakage fluid and compress it for reintroduction into the process depends on establishing a significant pressure difference, or "head," between the motive fluid input and the diffuser output. Accordingly, if the supply of high-pressure process fluid is interrupted, then the ejector will no longer be able to capture the leakage fluid. For example, if the high-pressure process fluid is drawn from the output of a compressor, then the ejector will not function when the compressor is not fully operating, either because it is being operated intermittently, it is being operated only slowly, (for example during start-up, preparing for shut-down, or in a stand-by mode), or because it has been stopped during maintenance.

One possibility is to re-direct the motive fluid input and/or the diffuser output to alternative locations in the process. For example, if a plurality of compressors are implemented in the process, then it may be possible to redirect the output of a second compressor to the motive fluid input of the ejector if the first compressor is temporarily out of service Nevertheless, it may be impossible to ensure that a high-pressure source of process fluid will always be available. For that reason, the system of the present invention further includes a leakage compressor or pump as a secondary capture mechanism, referred to herein as the "leakage booster." When there is no source of high-pressure process fluid available, remotely operated valves are caused by a controller to redirect the leakage fluid from the ejector to the leakage booster, and power is applied to the leakage booster so as to capture the leakage fluid and recycle it into the input of the compressor or to another destination in the process.

During normal operation, when the ejector is in full operation, no power is supplied to the leakage booster, i.e. the leakage booster is switched off, so that no electrical power is consumed by the system. Electrical power is therefore only consumed by the invention when high-pressure process fluid is not available, which in many applications is infrequent and of relatively short duration.

The leakage fluid is typically at a low pressure when it enters the ejector, due to its expansion after leaking through a seal, joint, fitting, or other structure. This pressure is reduced still further by the suction of the ejector. Similarly, the pressure of the motive fluid is greatly reduced as it is accelerated through the throat of the ejector. It is therefore necessary to significantly compress the process fluid mixture so that it reaches a pressure that is above the input fluid pressure of the compressor or other "lower pressure" location. Otherwise, there will be a tendency for process fluid to flow in a reverse direction from the inlet of the compressor or other "lower pressure" location into the diffuser of the ejector.

In embodiments, if a single ejector is unable to sufficiently compress the process fluid mixture, a second ejector is implemented, whereby the output of the first ejector is directed to the suction input of the second ejector, and whereby the higher-pressure process fluid is provided as the motive fluid of both the first and the second ejector. This approach can be extended to three or more ejectors if needed.

Embodiments further increase the efficiency of the ejector (s) by implementing a "cyclone" technology that imparts a rotational motion to the motive gas as it flows through the ejector. This approach serves to increase the local velocity of the motive fluid as it mixes with the leakage fluid, while retarding the longitudinal flow of the fluid mixture through the diffuser. As a result, the pressure at the suction input of the ejector is maintained or reduced, while the pressure of the fluid mixture at the output of the ejector is increased.

In many cases, implementation of the present invention for different specific applications requires optimization of the throat design in terms of its inlet diameter, degree of nozzle constriction, and so forth. Often, the diffuser and other elements of the ejector are satisfactory for a wide range of operating conditions, such that only modifications to the throat are needed. It can also happen that the throat of the ejector becomes worn, damaged, or clogged, while the remainder of the ejector is undamaged. Accordingly, embodiments of the present invention incorporate a "modular" ejector that includes an exchangeable throat. This approach allows relatively fewer ejectors to be maintained in inventory in anticipation of customer needs, with only the exchangeable throats being required in larger quantities. Whenever it becomes necessary to configure a system for a new customer, or to re-adapt an already deployed system to new operating conditions, it is only necessary to select and install an optimal throat into an otherwise "universal" ejector design. Similarly, if the throat of an ejector becomes worn, damaged, or clogged, it can easily be replaced without removing the entire ejector from the system, and while requiring only a spare throat, rather than an entire spare ejector.

A first general aspect of the present invention is a booster-ejector system configured for capturing and recycling a leakage fluid as it escapes from a process that includes a higher-pressure (HP) region normally containing a process fluid at a higher-pressure, and a lower pressure (LP) region normally containing the process fluid at a lower pressure. The system includes an ejector system (ES) having an ES motive fluid input, an ES leakage fluid input, and an ES fluid mixture output, the ejector system comprising a first ejector (FE) having an FE motive fluid input connected to the ES motive fluid input, an FE suction input connected to the ES leakage fluid input, an FE mixing chamber, and an FE diffuser, the first ejector being configured to draw the leakage fluid through the FE suction input into the FE mixing chamber, to accept motive fluid into the FE mixing chamber through the FE motive fluid input, to entrain the leakage fluid within the motive fluid, and to compress the resulting fluid mixture as it flows out of the first ejector through the FE diffuser.

The system further includes a first throat within the FE mixing chamber, the motive fluid being directed through the first throat as it flows into the FE mixing chamber, the first throat comprising a constricted nozzle configured to accelerate a rate of flow of the motive fluid as it flows through the first throat, an electrically driven leakage fluid booster having a booster inlet and a booster outlet, the leakage fluid booster being configured to pump the leakage fluid to the LP region, and a controller configured to control the leakage fluid pump and a plumbing system according to a process fluid pressure difference between the HP and LP regions of the process, referred to herein as the "head" of the ejector, such that when head of the ejector exceeds a specified value, electrical power is not consumed by the leakage fluid pump, and the leakage fluid flows through the ejector system to the LP region, and when the head of the ejector is below the specified value, the leakage fluid pump operates to pump the leakage fluid to the LP region.

In embodiments, the first ejector is configured to enable replacement of the first throat by a second throat.

In any of the above embodiments, the first throat can be configured to impart a rotational component of motion to the motive fluid as it flows out of the first throat.

In any of the above embodiments, the leakage fluid pump can be a reciprocal pump.

In any of the above embodiments, the HP and LP regions can be, respectively, an input and an output of a fluid compressor.

In any of the above embodiments, the ejector system can further include a second ejector, wherein a motive fluid input of the second ejector is connected to the ES motive fluid input, a suction input of the second ejector is connected to the FE diffuser, and a diffuser of the second ejector is in fluid communication with the ES fluid mixture output.

In any of the above embodiments, the controller can be further configured to control the ejector head.

A second general aspect of the present invention is a method of capturing and recycling a leakage fluid as it escapes from a process that includes a higher-pressure (HP) region normally containing a process fluid at a higher-pressure, and a lower pressure (LP) region normally containing the process fluid at a lower pressure. the method includes providing a booster-ejector system according to any embodiment of the first general aspect, determining by the controller of a process fluid pressure difference between the HP and LP regions of the process, referred to herein as the "head" of the ejector, upon the head of the ejector exceeding a specified value, configuring by the controller of the leakage fluid booster and the plumbing system in a first mode wherein electrical power is not consumed by the leakage fluid pump and the leakage fluid flows through the ejector system to the LP region, and upon the head of the compressor falling below the specified value, configuring by the controller of the leakage fluid booster and the plumbing system in a second mode wherein the leakage fluid booster operates to pump the leakage fluid to the LP region.

Embodiments further include replacing the first throat by a second throat.

In any of the above embodiments, the first throat can be configured to impart a rotational component of motion to the motive fluid as it flows out of the first throat.

In any of the above embodiments, the leakage fluid booster can be a reciprocal booster.

In any of the above embodiments, the HP and LP regions can be, respectively, an input and an output of a fluid compressor.

In any of the above embodiments, the ejector system can further include a second ejector, wherein a motive fluid input of the second ejector is connected to the ES motive fluid input, a suction input of the second ejector is connected to the FE diffuser, and a diffuser of the second ejector is in fluid communication with the ES fluid mixture output.

Any of the above embodiments can include controlling by the controller of the head of the ejector.

And in any of the above embodiments, providing the booster-ejector system can include providing an FE housing comprising a FE motive fluid input, a FE suction input, a FE mixing chamber, and a FE diffuser; selecting a throat that is suitable for operating conditions of the process; and installing the throat within the ejector housing, thereby providing the first ejector of the booster-ejector system.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a system and method for recapturing and recycling a leakage fluid while reducing or avoiding release of the leakage fluid or its combustion products into the environment, while minimizing energy costs. The invention is applicable to systems in which a process fluid is present at both a higher-pressure and a lower pressure, for example a system that includes a compressor that compresses a process fluid, so that the compressor has a relatively lower-pressure fluid input and a relatively higher-pressure fluid output.

It will be noted that examples and descriptions are sometimes presented herein with reference to a system that compresses a gas, such as natural gas, and that captures and recycles leaked quantities of the gas. However, it should be understood that the present disclosure applies equally to systems for which the process fluid is a liquid, unless otherwise required by context. Examples are presented herein where the leakage fluid arises from a compressor, for example from a shaft seal, fitting, or joint within the compressor. However, is should be understood that, in general, the invention is applicable to recapturing and recycling leaked process fluid that arises from any source of leakage, so long as a higher-pressure source of the process fluid is available, as well as another location where the process fluid is present at a lower pressure.

Figure 1A:
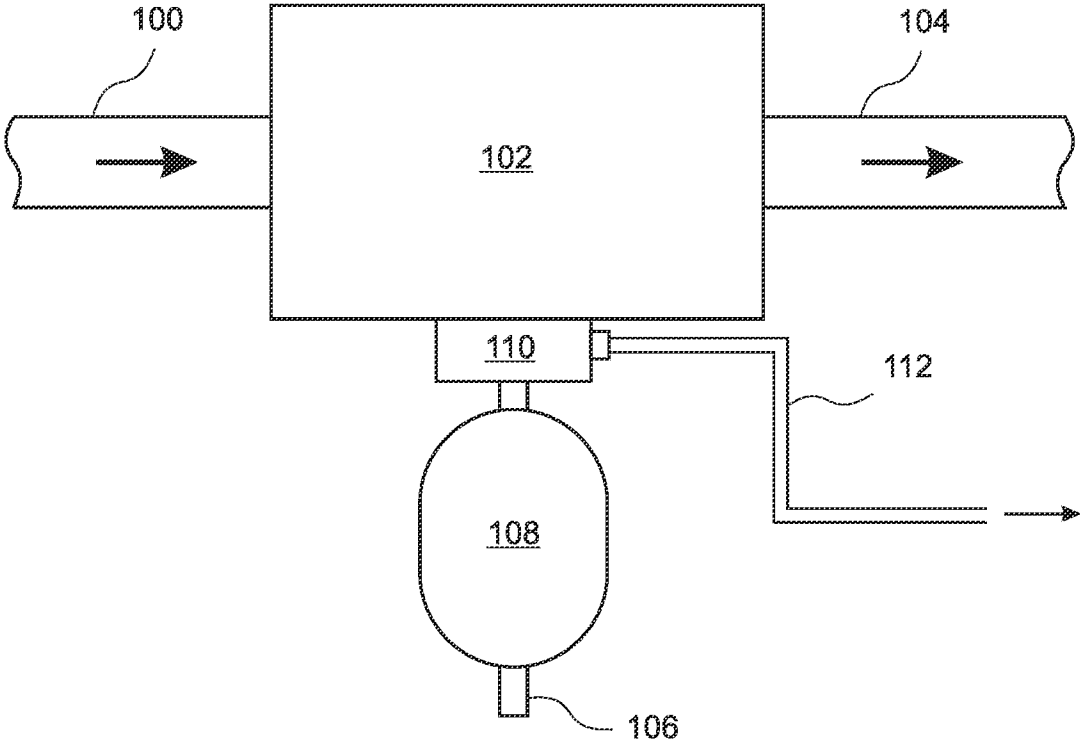
Fig. 1A Prior Art
Fig. 1A is a simplified illustration of leakage gas being vented from a compressor according to the prior art.
Figure 1B:
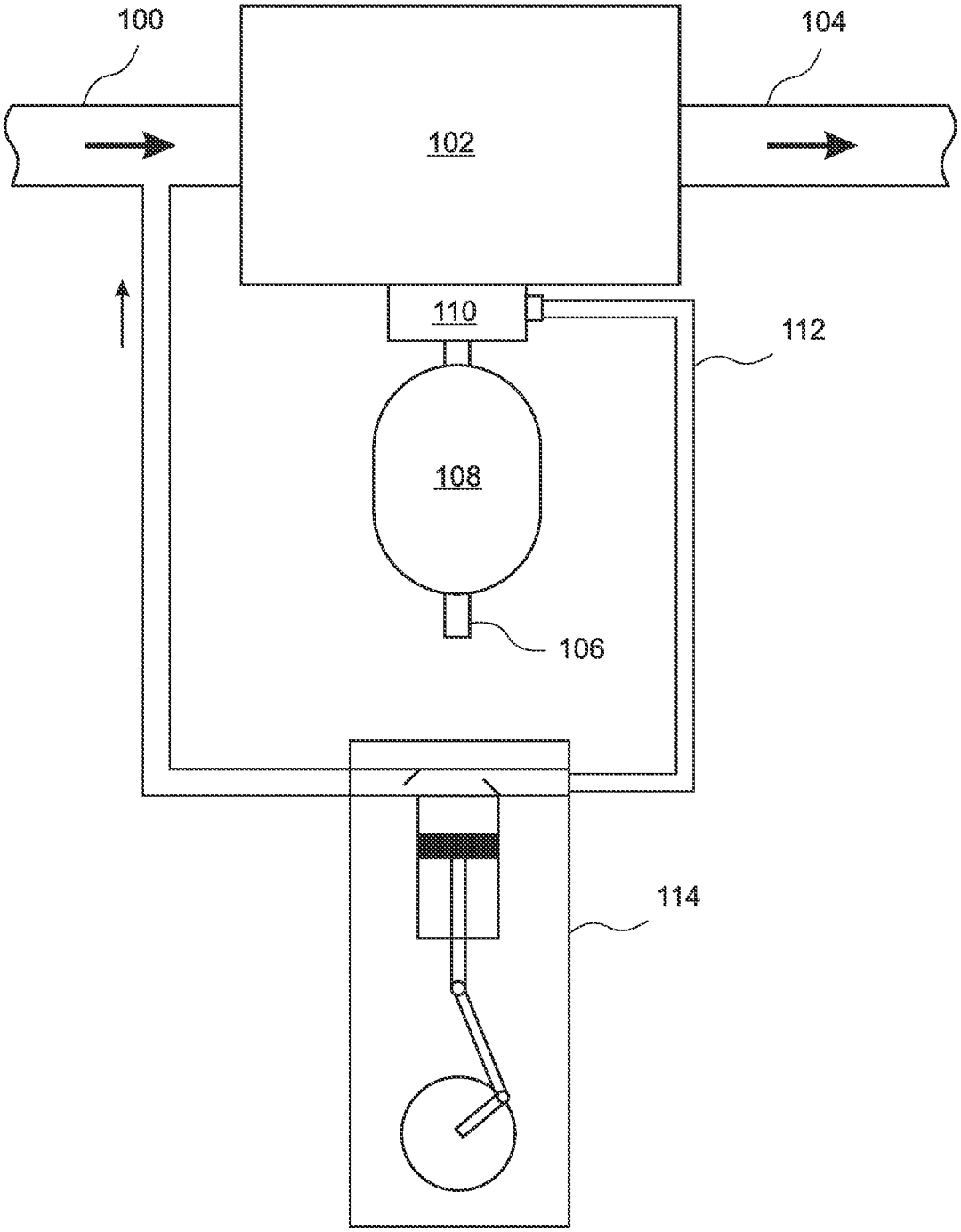
Fig. 1B Prior Art
FIG. 1B is a simplified illustration of leakage gas being recycled by a leakage pump to the inlet of a compressor according to the prior art.
Figure 2:
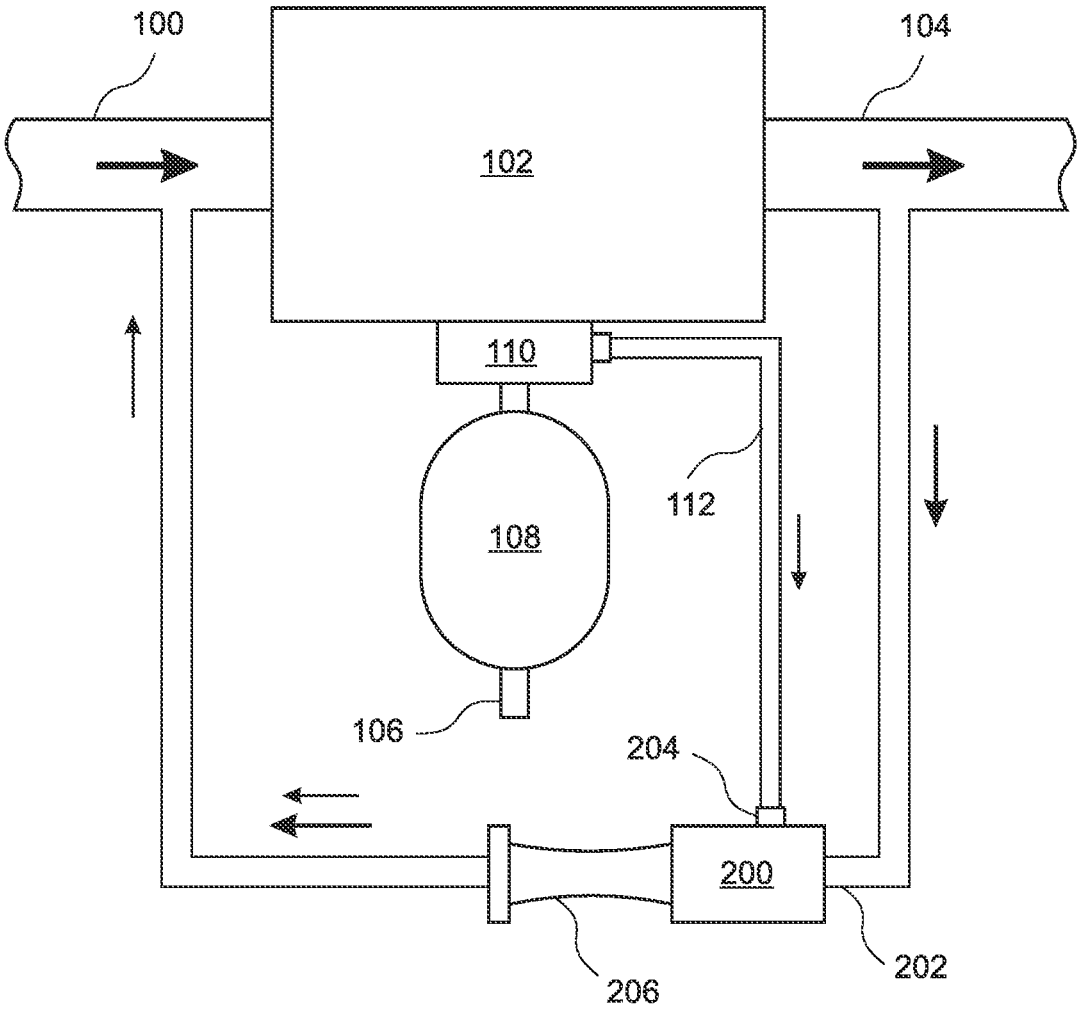
FIG. 2 illustrates recycling by an ejector of leakage fluid to the inlet of a compressor according to a partial embodiment of the present invention.

With reference to FIG. 2, according to the present invention an ejector 200 is implemented as a primary capture mechanism for capturing and re-compressing the leakage fluid. In the illustrated example, process fluid from the output 104 of a compressor 102 is provided to the "motive fluid" input 202 of the ejector 200, while the suction input 204 of the ejector 200 is connected to the source 110 of the leaked fluid. The ejector 200 then functions to draw in the leakage fluid, which is entrained in the motive fluid, after which the mixture of motive fluid and leakage fluid, referred to herein as the "process fluid mixture," is compressed in the diffuser section 206 of the ejector and returned to a location of lower process fluid pressure, which in the illustrated example is the input of the compressor.

This approach is highly energy efficient, in that the ejector 200 is simple in design, has no moving parts, and does not consume any electrical power. Because of the low flow rate of the leakage fluid, and the consequent low flow that is required of the motive fluid, there is only a negligible loss in the efficiency of the compressor 102 due to the redirection of a small amount of output fluid to the ejector 200.

Of course, the ability of the ejector of FIG. 2 to apply suction to draw in the leakage fluid and compress it for reintroduction into the input 100 of the compressor 102 depends on establishing a significant pressure difference, or "head," between the compressor input 100 and output 104. Accordingly, when the compressor 102 is not fully operating, either because it is being operated intermittently, it is being operated only slowly, (for example during start-up, preparing for shut-down, or in a stand-by mode), or because it has been stopped during maintenance, leakage may still occur, but the ejector 200 will not be able to capture it.

One possibility is to re-direct the motive fluid input 202 and/or the diffuser output 206 of the ejector 200 to alternative locations in the process. For example, if a plurality of compressors 102 are implemented in the process, then it may be possible to redirect the output of a second compressor to the motive fluid input 202 of the ejector 200 if the first compressor 102 is temporarily out of service. Nevertheless, it may be impossible to ensure that a high-pressure source of process fluid will always be available.

Figure 3:
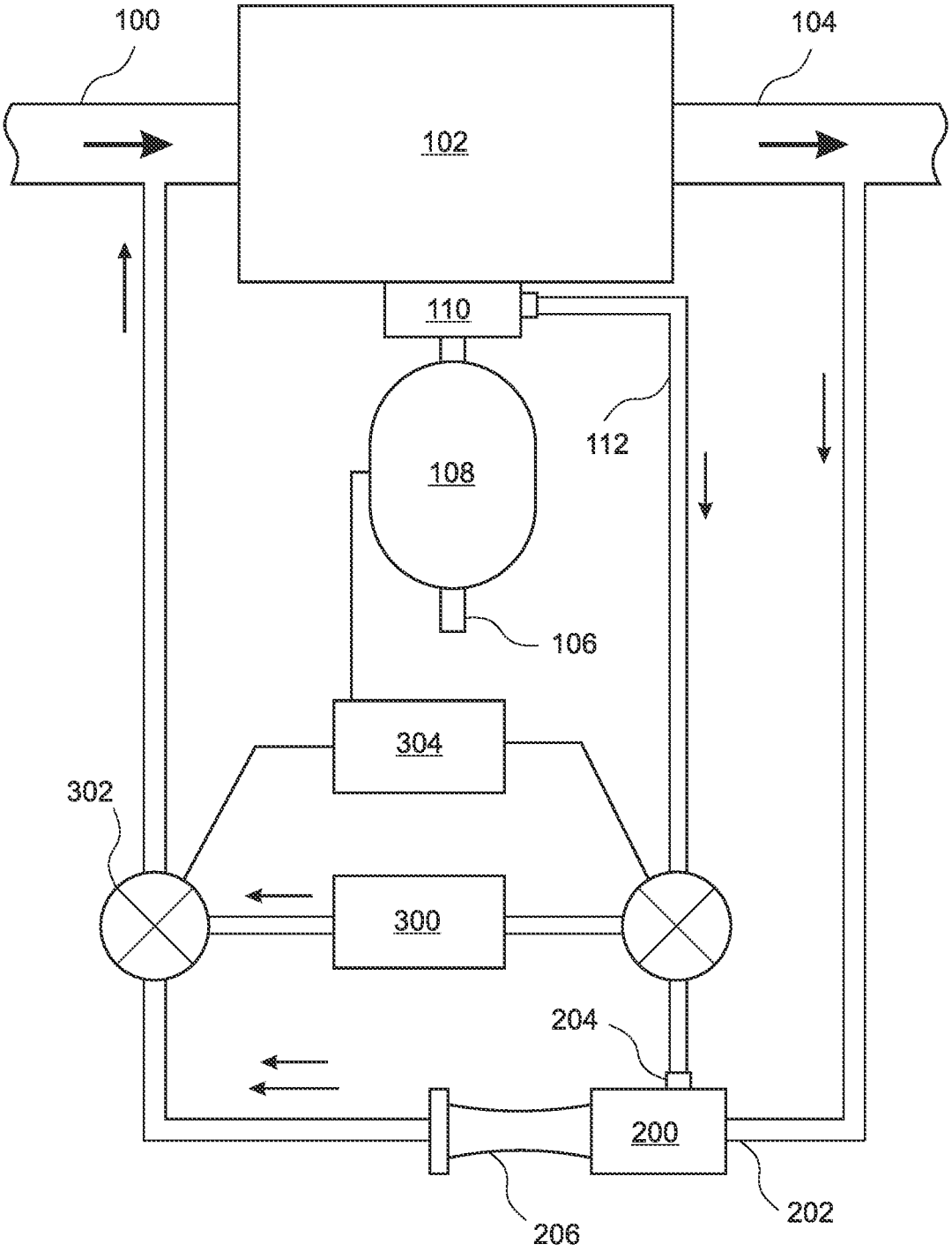
FIG. 3 illustrates an embodiment of the present invention that includes only one ejector combined with a controller and a leakage fluid pump.

For that reason, with reference to FIG. 3, the system of the present invention further includes a leakage compressor or pump 300 as a secondary capture mechanism, referred to herein as the "leakage booster" 300. When a source of high-pressure process fluid is not available, for example when the compressor 102 of FIG. 3 is not in full operation, remotely operated valves 302 are actuated by a controller 304 to redirect the leakage fluid from the ejector 200 to the leakage pump 300, and power is applied to the leakage booster 300 so as to capture the leakage fluid and return it to the input 100 of the compressor 102.

During normal operation, when the compressor 102 and ejector 200 of FIG. 3 are in full operation, power is not directed to the leakage booster 300, i.e. the leakage pump 300 is switched off, so that no electrical power is consumed by the system. Electrical power is therefore only consumed by the embodiment of FIG. 3 during periods of time when the compressor 102 is not fully operating, which in many applications are infrequent and of relatively short duration. In the embodiment of FIG. 3, the controller 304 that controls the actuation of the valves 302 and the switching on and off of the leakage booster 300 is coordinate with, or is controlled by, the operation of the compressor 102, such that the system automatically switches between the ejector 200 and the leakage pump 300 depending on the operating mode of the compressor 102.

The leakage fluid is typically at a low pressure when it enters the ejector input 204, due to its expansion after leaking through a seal or other structure 110. This pressure is reduced still further by the suction of the ejector 200. Similarly, the pressure of the motive fluid is greatly reduced as it is accelerated through the throat of the ejector 200. Significant compression of the process fluid mixture is therefore required so that it will be above the process fluid pressure when it reaches the input 100 of the compressor 102. Otherwise, in the embodiment of FIG. 3, there will be a tendency for process fluid to flow in a reverse direction from the inlet 100 of the compressor 102 into the diffuser 206 of the ejector 200.

Figure 4:
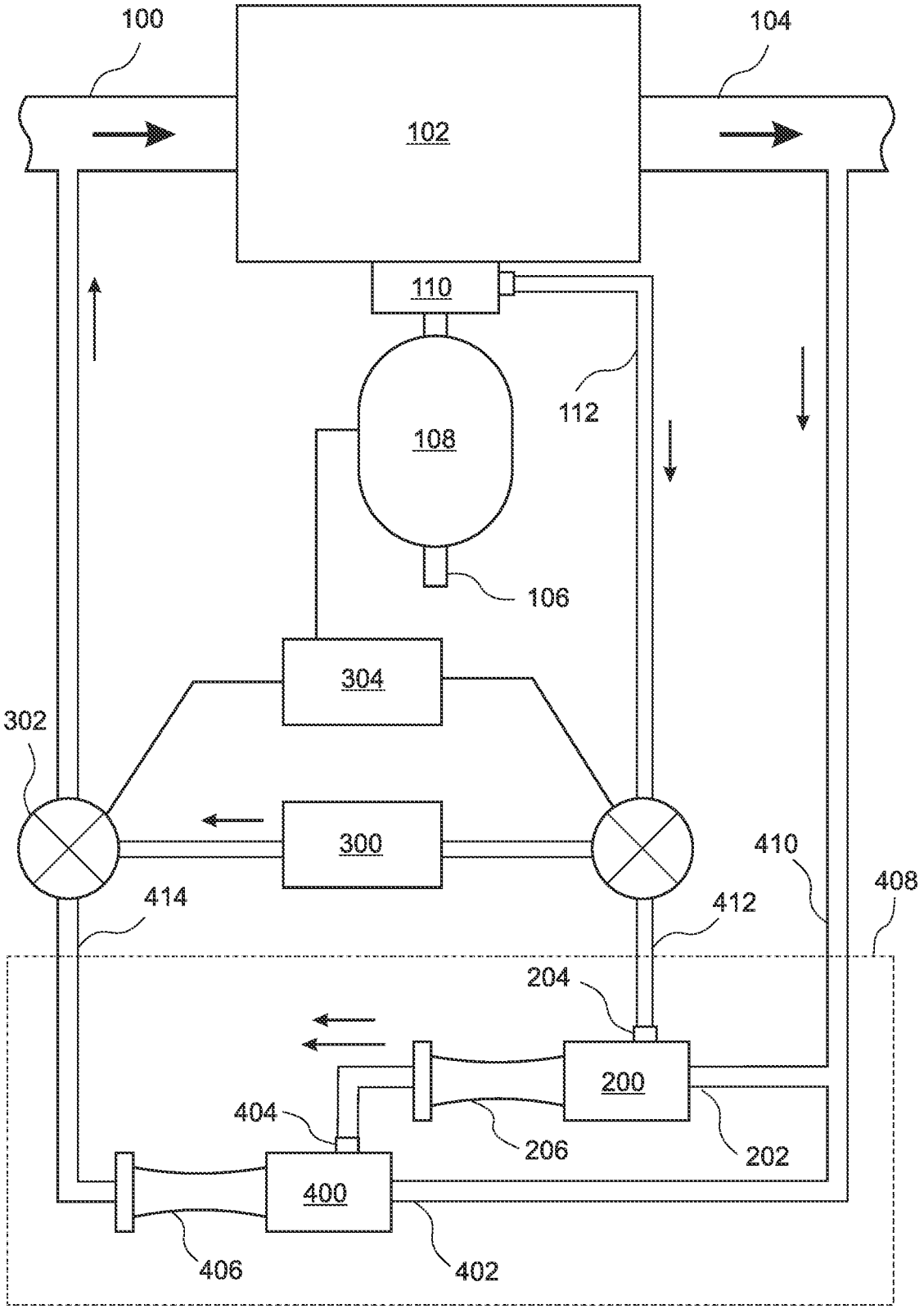
FIG. 4 illustrates an embodiment of the present invention that includes an ejector system comprising two ejectors combined with a controller and a leakage booster.

With reference to FIG. 4, in embodiments, if a single ejector 200 is unable to sufficiently raise the pressure of the process fluid mixture, a second ejector 400 is implemented, whereby the output of the first ejector 200 is directed to the suction input 404 of the second ejector 400, and whereby process fluid from the high-pressure source, for example in FIG. 3 the fluid from the output 104 of the compressor 102, is provided to the motive fluid inputs 202, 402 of both the first ejector 200 and the second ejector 400. The output of the diffuser 406 of the second ejector 400 is then directed to the input 100 of the compressor 102. In embodiments, the plurality of ejectors 200, 400 are combined within an ejector "system" 408 that accepts fluid from the high-pressure process fluid source such as from the outlet 104 of the compressor 102, into a system motive fluid input 410, and leakage fluid through a system leakage fluid inlet 412, and directs mixed motive and leakage fluids to the inlet 100 of the compressor 102 from a system fluid mixture outlet 414. This approach can be extended to three or more ejectors if needed.

Figure 5A:
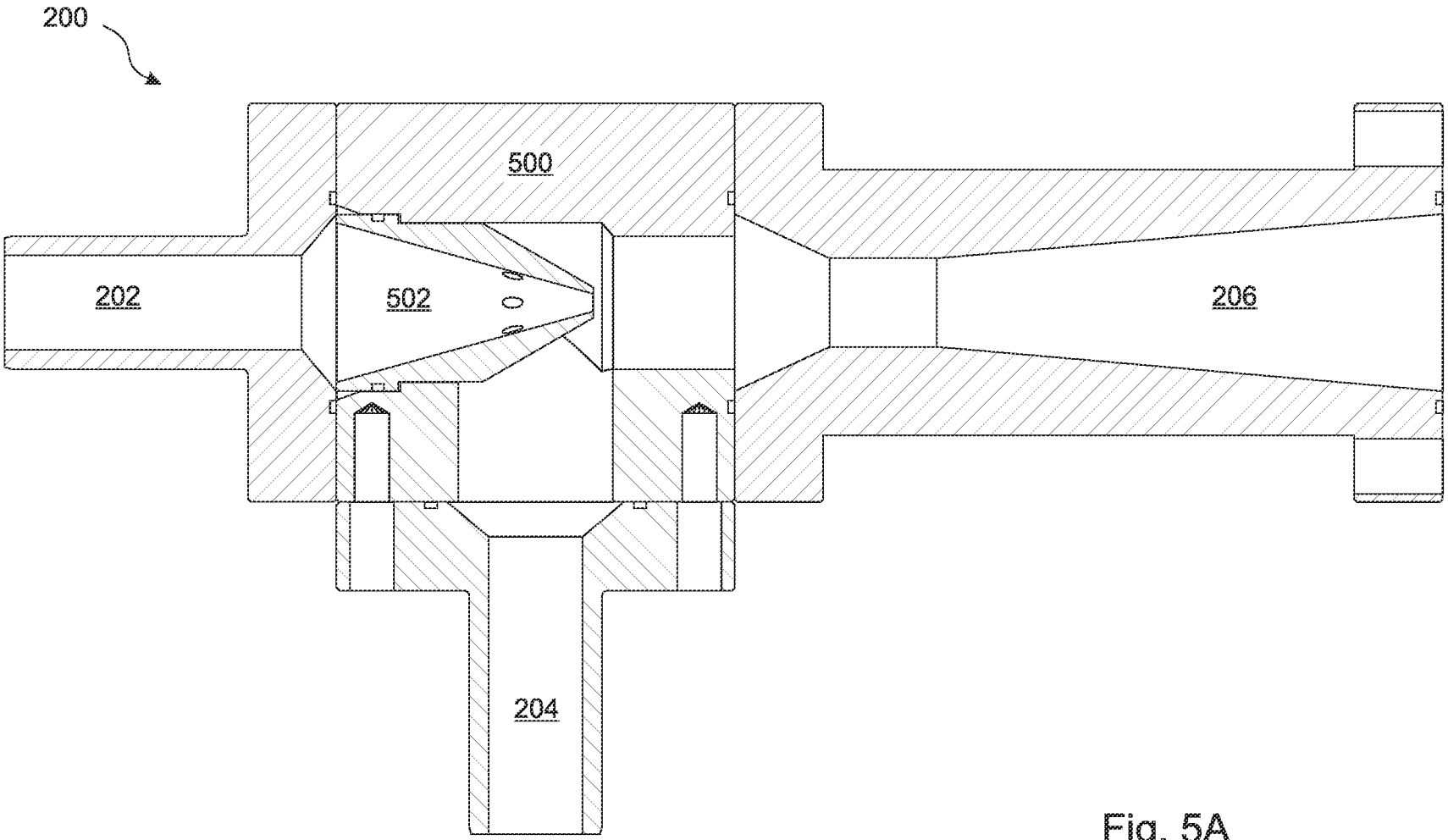
FIG. 5A is a sectional view drawn to scale of an ejector that includes an exchangeable throat with cyclone fluid outlets according to an embodiment of the present invention.
Figure 5B:
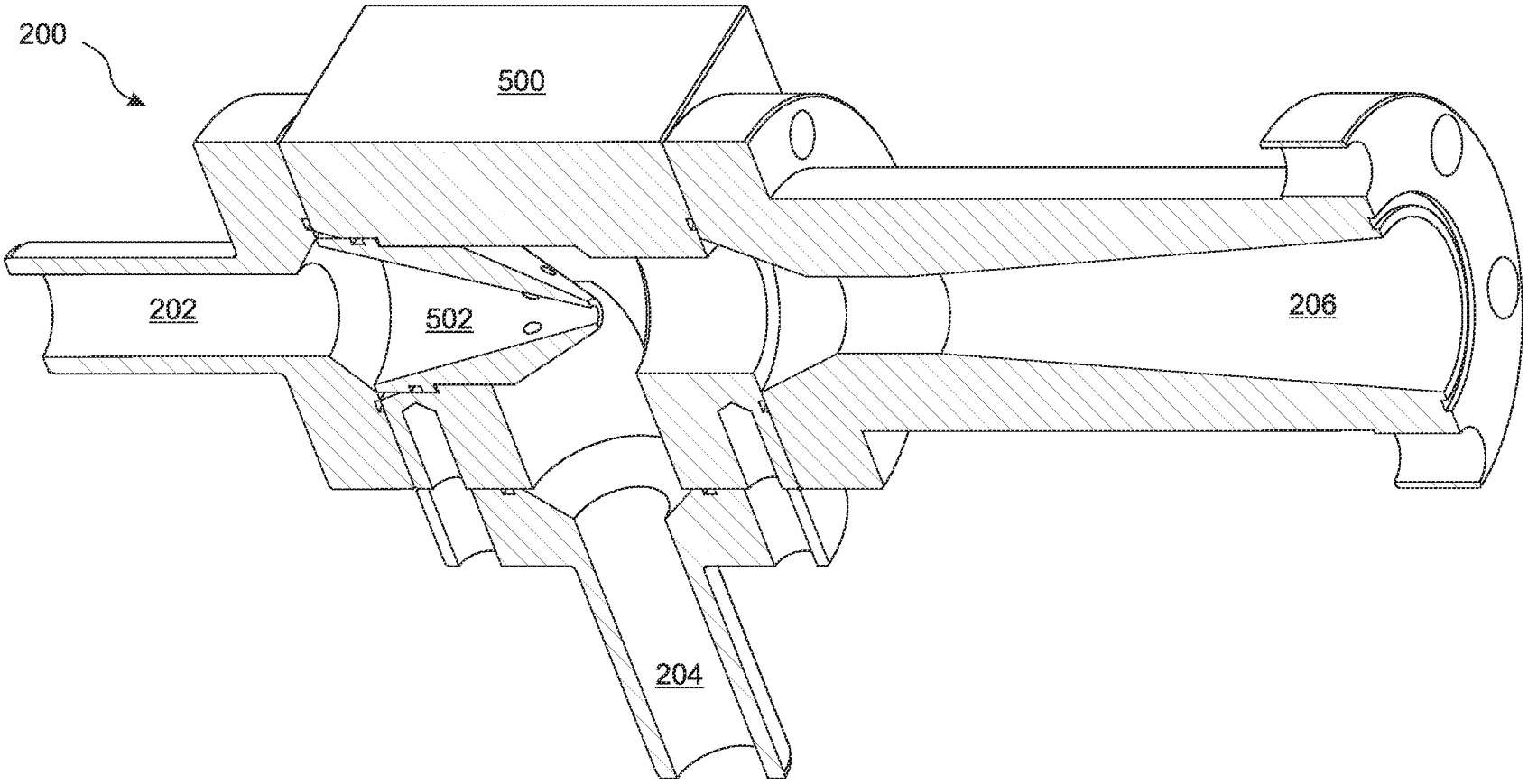
FIG. 5B is a sectional perspective view drawn to scale of the ejector of FIG. 5A.

FIGS. 5A and 5B are sectional side and perspective views of an ejector 200 in an embodiment of the present invention. It can be seen in the drawings that both the motive fluid input 202 and the leakage fluid input 204 lead to a "suction chamber" 500 of the ejector 200, where the two gases are mixed, after which they are accelerated and pressurized within the diffuser section 206 of the ejector 200. In particular, the motive fluid input 202 directs the motive fluid through a "throat"502 that is included within the mixing chamber 500.

In many cases, implementation of the present invention for different specific applications requires optimization of the design of the throat 502 in terms of its inlet diameter, degree of nozzle constriction, and so forth. Often, the diffuser 206 and other elements of the ejector 200 are satisfactory for a wide range of operating conditions, such that only modifications to the throat 502 are needed. It can also happen that the throat 502 of the ejector 200 becomes worn, damaged, or clogged, while the remainder of the ejector 200 is undamaged.

Figure 5C:
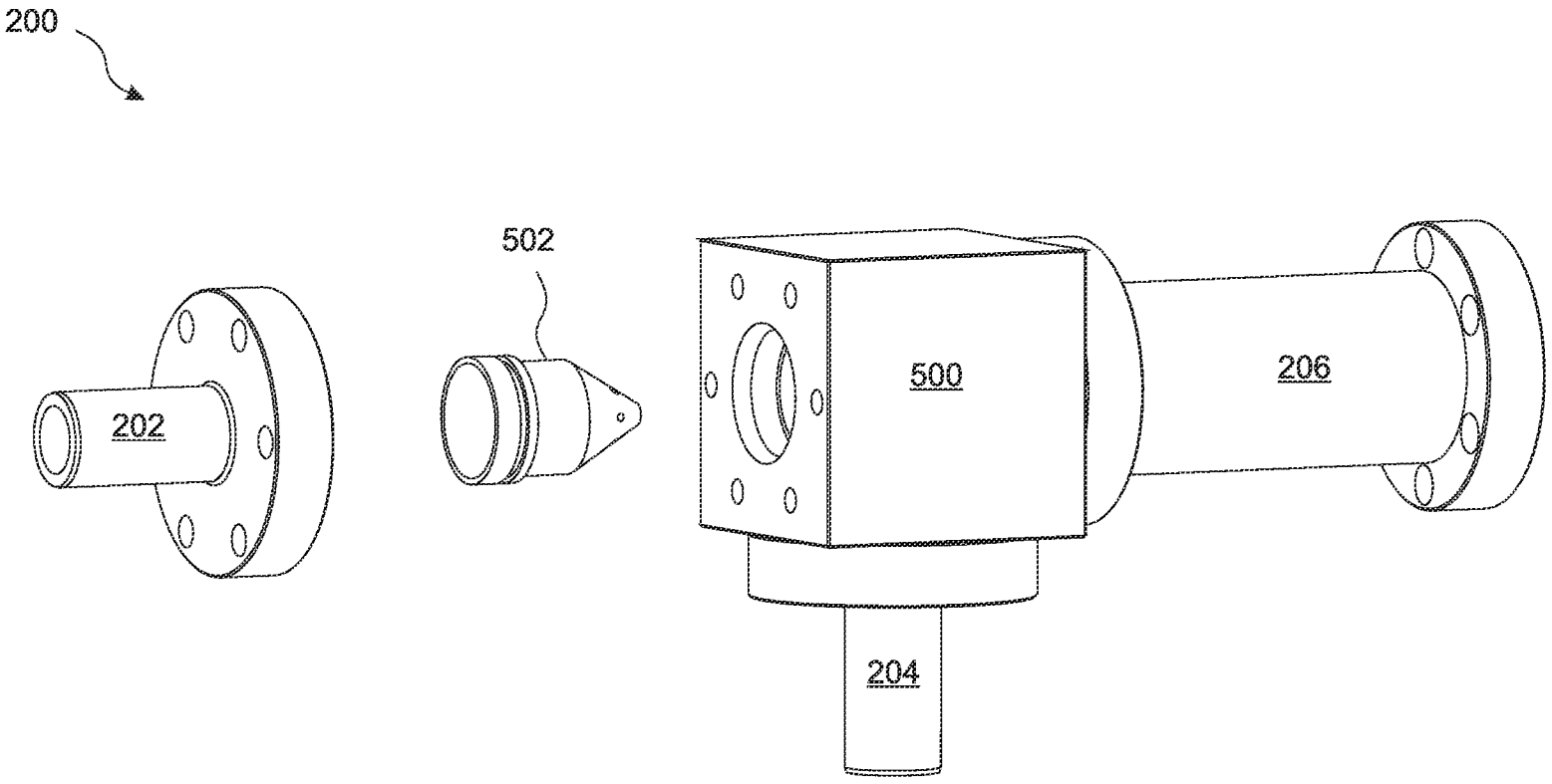
FIG. 5C is an exploded perspective view drawn to scale of the embodiment of FIGS. 5A and 5B.

Accordingly, with reference to the exploded perspective view of FIG. 5C, embodiments of the present invention incorporate a "modular" ejector 200 that includes an exchangeable throat 502. This approach allows relatively fewer ejectors 200 to be maintained in inventory in anticipation of customer needs, with only the exchangeable throats 502 being required in larger quantities. Whenever it becomes necessary to configure a system for a new customer, or to re-adapt an already deployed system to new operating conditions, it is only necessary to select and install an optimal throat 502 into an otherwise "universal" ejector design. Similarly, if the throat 502 of an ejector 200 becomes worn, damaged, or clogged, it can easily be replaced without removing the entire ejector 200 from the system, and while requiring only a spare throat 502, rather than an entire spare ejector 200.

Figure 5D:
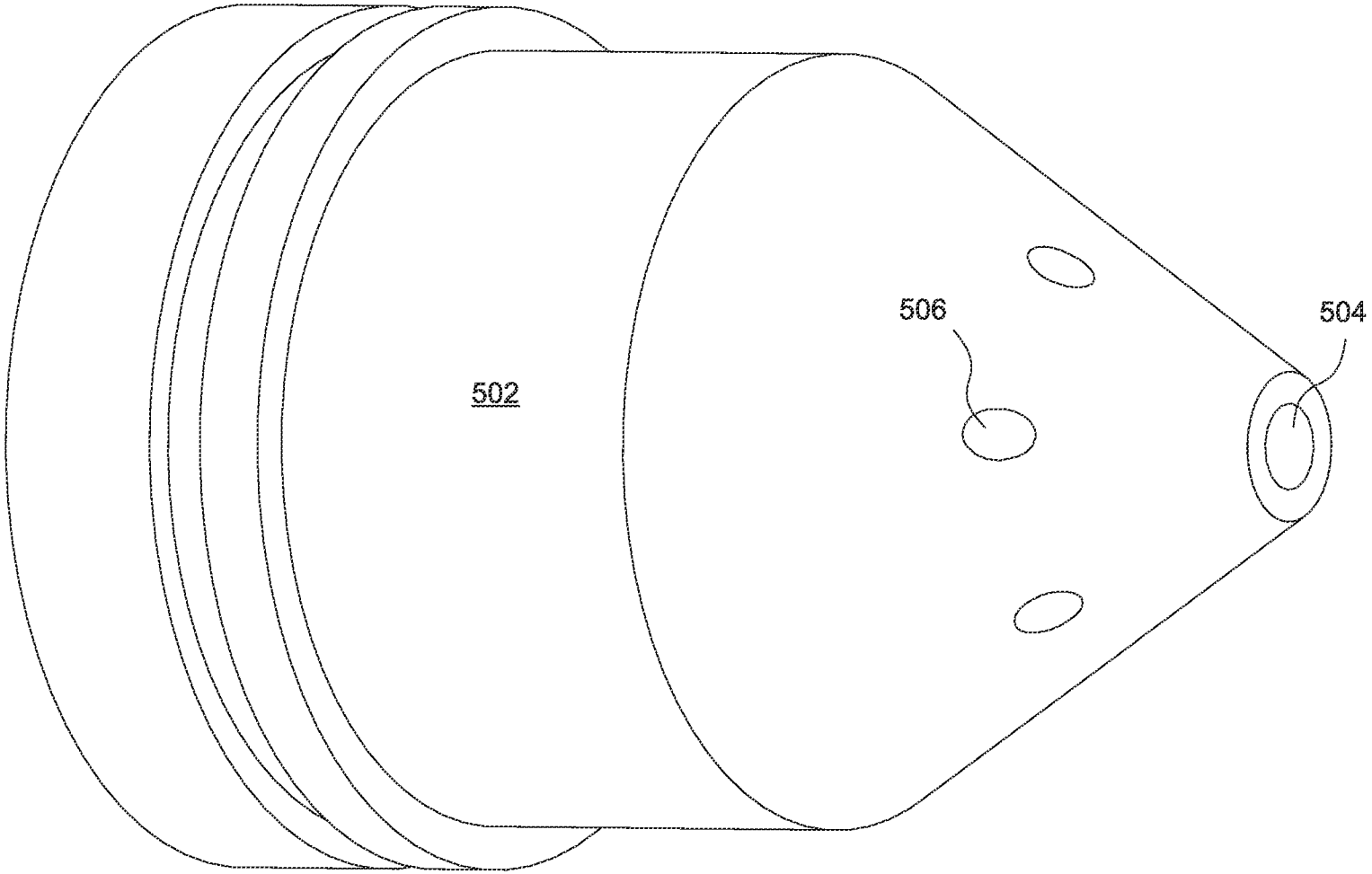
FIG. 5D is a close-up perspective view drawn to scale of the throat of FIG. 5A-5C.

FIG. 5D is an enlarged perspective view of the throat 502 of FIGS. 5A-5C. It can be seen in the drawing that the throat 502 terminates in a restricted "nozzle" 504. The illustrated embodiment further increases the efficiency of the ejector 202 by implementing a "cyclone" technology by including additional circulating fluid outlets 506 that impart a rotational motion to the motive gas as it flows out of the throat 502. This approach serves to increase the local velocity of the motive fluid as it mixes with the leakage fluid, while retarding the longitudinal flow of the fluid mixture through the diffuser 206. As a result, the pressure at the suction input 202 of the ejector 200 is maintained or reduced, while the pressure of the fluid mixture at the output of the ejector 200 is increased.

Figure 6:
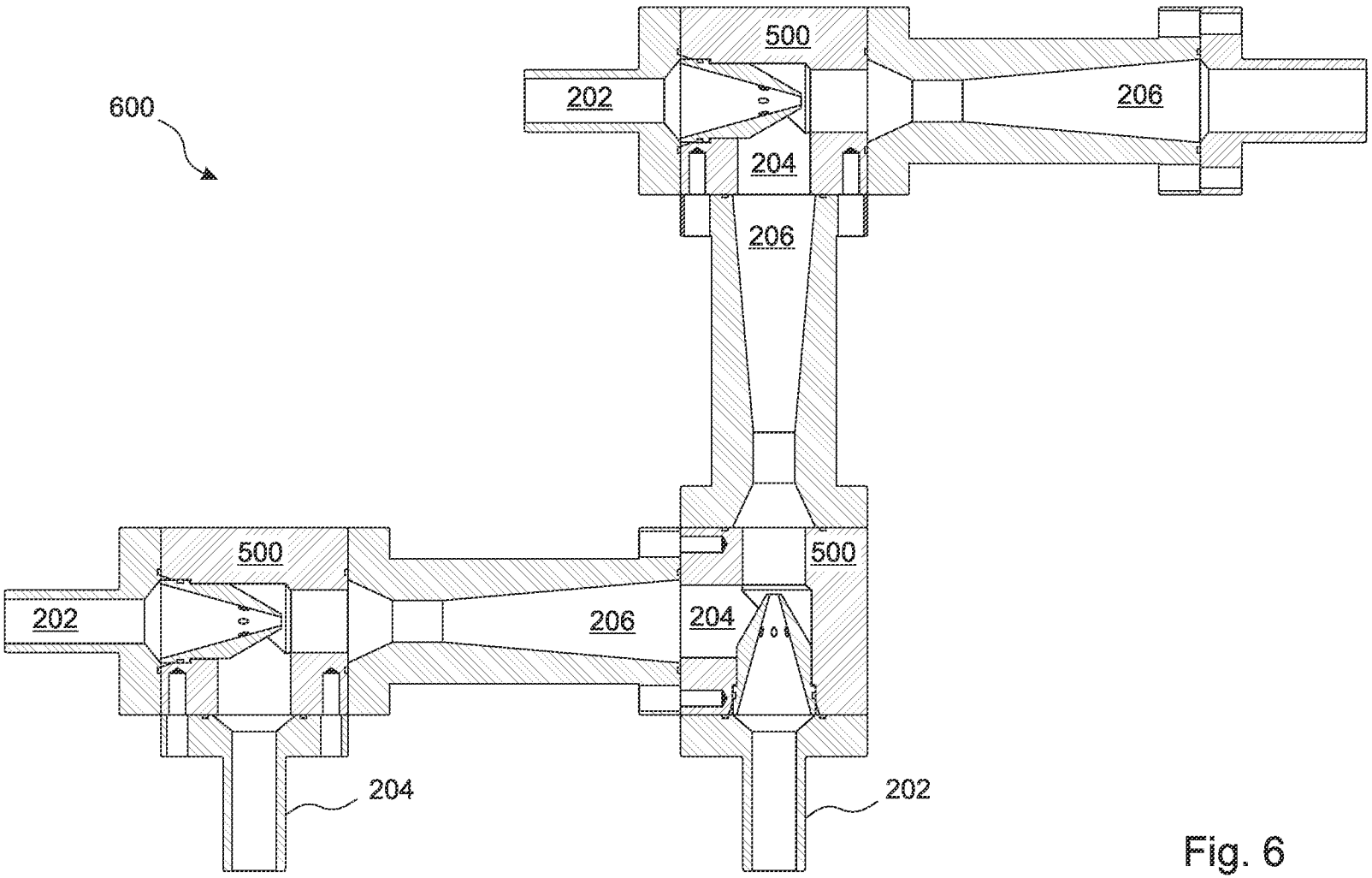
FIG. 6 is a sectional view drawn to scale of an ejector system comprising three ejectors according to an embodiment of the present invention.

As noted above with reference to FIG. 4, embodiments of the present invention include a plurality of ejectors 200 operating in series to achieve sufficient pressurization of the mixture of motive gas and leakage fluid before it is reinjected into the input 100 of the compressor 102 or other location with lower pressure process fluid. FIG. 6 illustrates a single ejector system 600 that comprises three ejectors in an embodiment of the present invention.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications. The disclosure presented herein does not explicitly disclose all possible combinations of features that fall within the scope of the invention. The features disclosed herein for the various embodiments can generally be interchanged and combined into any combinations that are not self- contradictory without departing from the scope of the invention. In particular, the limitations presented in dependent claims below can be combined with their corresponding independent claims in any number and in any order without departing from the scope of this disclosure, unless the dependent claims are logically incompatible with each other.

What is claimed is:

1. A booster-ejector system configured for capturing and recycling a leakage fluid as it escapes from a process that includes a higher-pressure (HP) region normally containing a process fluid at a higher-pressure, and a lower pressure (LP) region normally containing the process fluid at a lower pressure, the system comprising:

an ejector system (ES) having an ES motive fluid input, an ES leakage fluid input, and an ES fluid mixture output, the ejector system comprising a first ejector (FE) having an FE motive fluid input connected to the ES motive fluid input, an FE suction input connected to the ES leakage fluid input, an FE mixing chamber, and an FE diffuser, the first ejector being configured to draw the leakage fluid through the FE suction input into the FE mixing chamber, to accept motive fluid into the FE mixing chamber through the FE motive fluid input, to entrain the leakage fluid within the motive fluid, and to compress the resulting fluid mixture as it flows out of the first ejector through the FE diffuser;

a first throat included within the FE mixing chamber, the motive fluid being directed through the first throat as it flows into the FE mixing chamber, the first throat comprising a constricted nozzle configured to accelerate a rate of flow of the motive fluid as it flows through the first throat;

an electrically driven leakage fluid booster having a booster inlet and a booster outlet, the leakage fluid booster being configured to pump the leakage fluid to the LP region; and a controller configured to control the leakage fluid booster and a plumbing system according to a process fluid pressure difference between the HP and LP regions of the process, referred to herein as the "head" of the ejector, such that when head of the ejector exceeds a specified value, electrical power is not consumed by the leakage fluid pump, and the leakage fluid flows through the ejector system to the LP region, and when the head of the ejector is below the specified value, the leakage fluid booster operates to pump the leakage fluid to the LP region.

2. The system of claim 1, wherein the first ejector is configured to enable replacement of the first throat by a second throat.

3. The system of claim 1, wherein the first throat is configured to impart a rotational component of motion to the motive fluid as it flows out of the first throat.

4. The system of claim 1, wherein the leakage fluid booster is a reciprocal pump.

5. The system of claim 1, wherein the HP and LP regions are, respectively, an input and an output of a fluid compressor.

6. The system of claim 1, wherein the ejector system further comprises a second ejector, and wherein a motive fluid input of the second ejector is connected to the ES motive fluid input, a suction input of the second ejector is connected to the FE diffuser, and a diffuser of the second ejector is in fluid communication with the ES fluid mixture output.

7. The system of claim 1, wherein the controller is further configured to control the ejector head.

8. A method of capturing and recycling a leakage fluid as it escapes from a process that includes a higher-pressure (HP) region normally containing a process fluid at a higher-pressure, and a lower pressure (LP) region normally containing the process fluid at a lower pressure, the method comprising:

providing a booster-ejector system according to claim 1;

determining by the controller of a process fluid pressure difference between the HP and LP regions of the process, referred to herein as the "head" of the ejector;

upon the head of the ejector exceeding a specified value, configuring by the controller of the leakage fluid booster and the plumbing system in a first mode wherein electrical power is not consumed by the leakage fluid booster and the leakage fluid flows through the ejector system to the LP region; and upon the head of the compressor falling below the specified value, configuring by the controller of the leakage fluid booster and the plumbing system in a second mode wherein the leakage fluid booster operates to pump the leakage fluid to the LP region.

9. The method of claim 8, further comprising replacing the first throat by a second throat.

10. The method of claim 8, wherein the first throat is configured to impart a rotational component of motion to the motive fluid as it flows out of the first throat.

11. The method of claim 8, wherein the leakage fluid booster is a reciprocal booster.

12. The method of claim 8, wherein the HP and LP regions are, respectively, an input and an output of a fluid compressor.

13. The method of claim 8, wherein the ejector system further comprises a second ejector, and wherein a motive fluid input of the second ejector is connected to the ES motive fluid input, a suction input of the second ejector is connected to the FE diffuser, and a diffuser of the second ejector is in fluid communication with the ES fluid mixture output.

14. The method of claim 8, further comprising controlling of the head of the ejector by the controller.

15. The method of claim 8, wherein providing the booster-ejector system includes:

providing an FE housing comprising a FE motive fluid input, a FE suction input, a FE mixing chamber, and a FE diffuser;

selecting a throat that is suitable for operating conditions of the process; and installing the throat within the ejector housing, thereby providing the first ejector of the booster-ejector system.

* * * * *